US011197099B2

(12) United States Patent
Mao et al.

(10) Patent No.: US 11,197,099 B2
(45) Date of Patent: Dec. 7, 2021

(54) SCREEN SOUNDING DEVICE

(71) Applicant: AAC Technologies Pte. Ltd., Singapore (SG)

(72) Inventors: Lubin Mao, Shenzhen (CN); Zhaoxian Chen, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/992,114

(22) Filed: Aug. 13, 2020

(65) Prior Publication Data

US 2020/0396543 A1 Dec. 17, 2020

Related U.S. Application Data

(63) Continuation of application No. PCT/CN2019/091237, filed on Jun. 14, 2019.

(30) Foreign Application Priority Data

Jun. 12, 2019 (CN) ..... 201910506275.5

(51) Int. Cl.

| | |
|---|---|
| ***H04R 9/02*** | (2006.01) |
| ***H04R 1/02*** | (2006.01) |
| ***H04R 1/28*** | (2006.01) |
| ***H04R 9/06*** | (2006.01) |

(52) U.S. Cl.

CPC ..... *H04R 9/025* (2013.01); *H04R 1/023* (2013.01); *H04R 1/2834* (2013.01); *H04R 9/06* (2013.01); *H04R 2400/03* (2013.01)

(58) Field of Classification Search

CPC ..... H04R 9/025; H04R 9/06; H04R 1/023; H04R 1/2834; H04R 2400/03

See application file for complete search history.

(56) References Cited

U.S. PATENT DOCUMENTS

| | | | | |
|---|---|---|---|---|
| 4,015,227 A * | 3/1977 | Riko | H02K 33/06 | 335/231 |
| 5,528,697 A * | 6/1996 | Saito | B06B 1/045 | 340/407.1 |
| 8,934,228 B2 * | 1/2015 | Franklin | H04R 9/06 | 361/679.26 |
| 10,932,060 B2 * | 2/2021 | Du | B06B 1/045 | |
| 2009/0097692 A1 * | 4/2009 | Sakamoto | H04R 7/045 | 381/388 |

FOREIGN PATENT DOCUMENTS

GB 677225 A * 8/1952 ..... H04R 11/06

* cited by examiner

*Primary Examiner* — Sunita Joshi

(74) *Attorney, Agent, or Firm* — W&G Law Group

(57) ABSTRACT

The invention discloses a screen sounding device including a frame, a screen, and a driving device. The driving device has a magnetic circuit system fixed on screen, an electromagnet driving the magnetic circuit system to vibrate and fixed on the frame and an elastic connector connecting magnetic circuit system and electromagnet. The magnetic circuit system includes a magnet arranged around the electromagnet and a magnetic frame fixing the magnet. The magnetic frame includes a top wall fixed to the screen, a bottom wall arranged opposite to top wall and a side wall connecting the top wall and the bottom wall. The magnet is fixed on a side surface of the side wall facing the electromagnet. Applying the technical solution can meet low energy consumption and provide adequate stronger driving force.

8 Claims, 9 Drawing Sheets

A-A

SCREEN SOUNDING DEVICE

FIELD OF THE PRESENT DISCLOSURE

The present disclosure relates to a technology filed of a mobile terminal, especially related to one kind of a screen sounding device.

DESCRIPTION OF RELATED ART

In the mobile terminal of related technology, a driving unit used for sounding of a screen generally adopts structure design of piezoelectric type or moving coil type, and is arranged inside the whole machine of the mobile terminal. The integrated device or distributed device connects a middle frame (or a back cover) of a screen sounding device with the screen of a screen sounding device, and drives the screen to vibrate and generate sound through a driving device of piezoelectric type or moving coil type. But, the driving device of piezoelectric type needs larger voltage, high energy consumption, and the driving force of the driving device of a moving coil type is very limited.

Therefore, it is necessary to provide an improved screen sounding device with low energy consumption and larger driving force.

SUMMARY OF THE INVENTION

A major object of the present invention is to provide a screen sounding device with lower energy consumption and improved sound performance.

For achieving the object mentioned above, the present invention provides a screen sounding device comprising:

a frame;

a screen installed on the frame;

a driving device arranged between the frame and the screen for driving the screen to vibrate for generating sound; the driving device comprising:

a magnetic circuit system fixed on the screen;

an electromagnet fixed on the frame for driving the magnetic circuit system to vibrate, the magnetic circuit system including a magnet arranged around the electromagnet and a magnetic frame having a top wall fixing the screen, a bottom wall arranged opposite to the top wall and a side wall connecting the top wall to the bottom wall for fixing the magnet; wherein the screen sounding device further includes an elastic connector connecting the magnetic circuit system and the electromagnet, and the magnet is fixed on the side wall and facing a side surface of the electromagnet.

Further, the electromagnet comprises an iron core, a coil wound around the iron core, an upper magnetic covering plate arranged on the iron core and being close to one side of the screen, and a lower magnetic covering plate arranged on the iron core and being away from one side of the screen; the lower magnetic covering plate is fixed on the frame.

Further, the elastic connector comprises a fixing part fixed on the upper magnetic covering plate and being close to one side of the screen, a second fixing part fixed on the top wall and being away from one side of the screen, and an elastic arm connecting the first fixing part and the second fixing part.

Further, the magnet magnetizes along a vibration direction of the screen.

Further, the magnet is an integrated ring.

Further, the screen sounding device includes a plurality of magnets, wherein the plurality of magnets are distributed evenly surrounding the electromagnet.

Further, the top wall, the side wall and the bottom wall are integrally formed.

Further, the top wall, the side wall and the bottom wall are separately formed, and the top wall, the side wall and the bottom wall are welded and fixed with each other.

Further, the frame comprises a middle frame connected with the screen and a back cover covering one side of the middle frame opposite to the screen; the screen and the back cover, respectively with the middle frame separately, form a first accommodation cavity and a second accommodation cavity; the driving device is accommodated in the first accommodation cavity and the electromagnet is fixed in the middle frame.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

Figure 1:
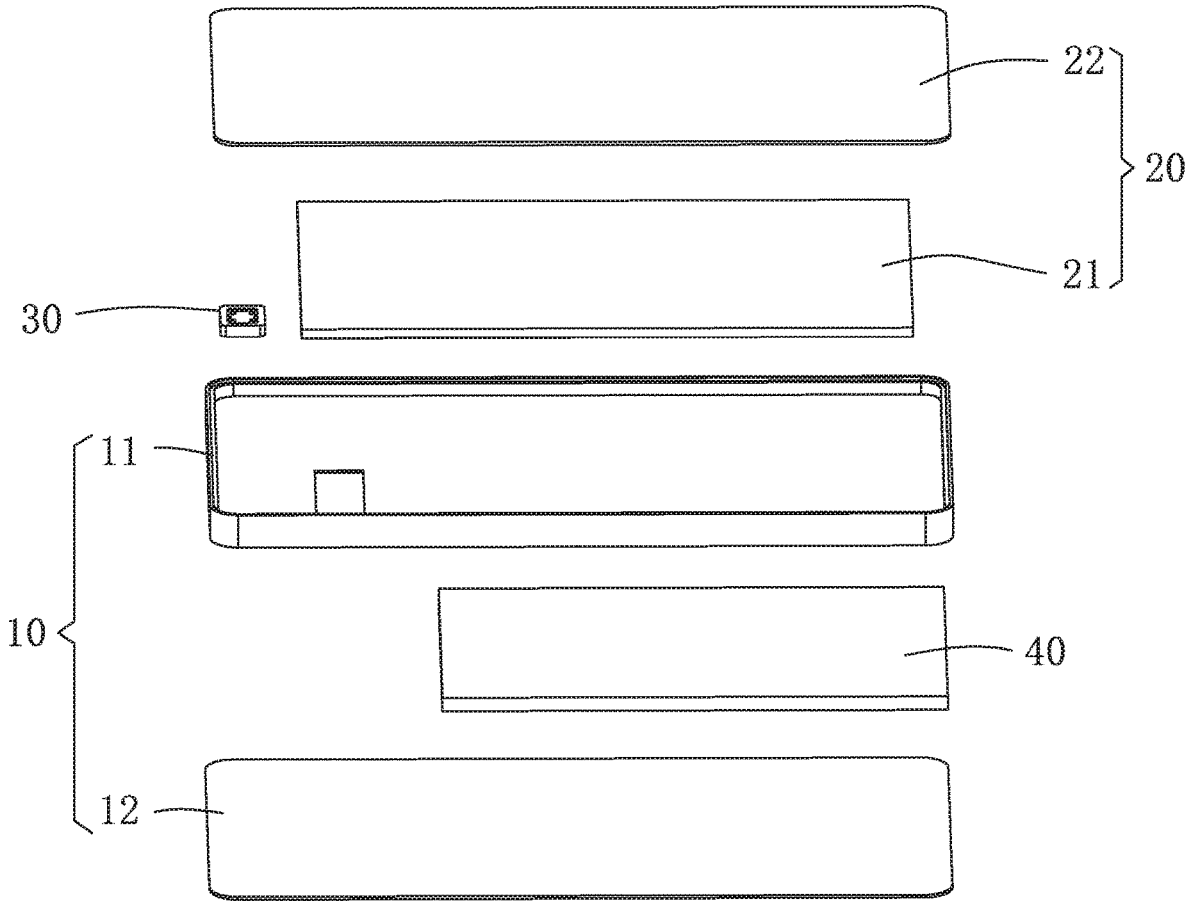
FIG. 1 is an exploded view of a screen sounding device in accordance with a first embodiment of the present invention.
Figure 2:
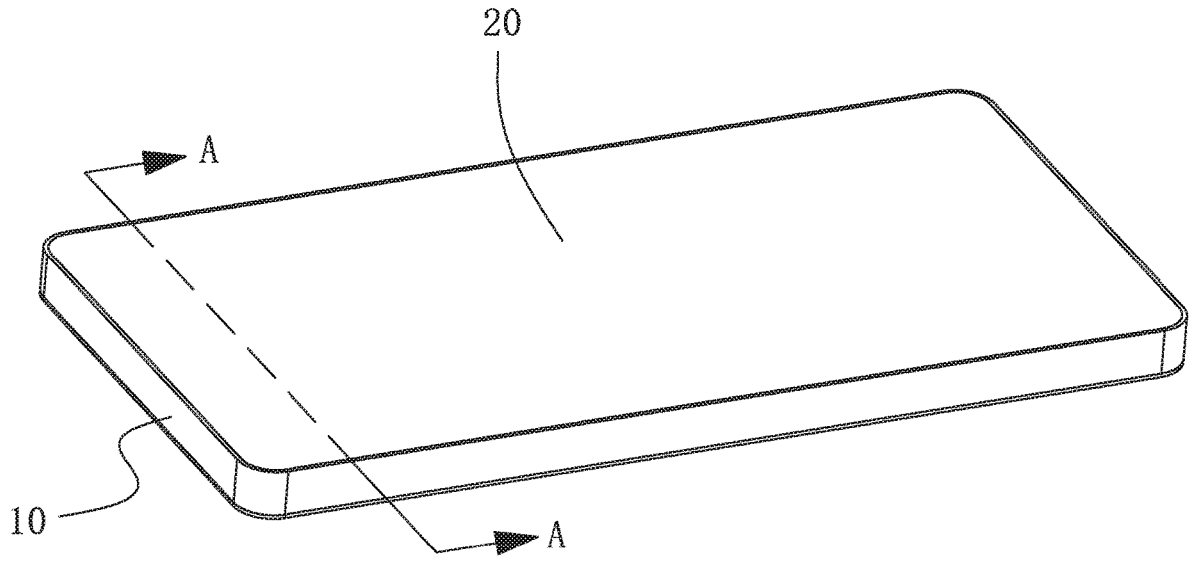
FIG. 2 is an assembled view of a screen sounding device in accordance with the first embodiment.
Figure 3:
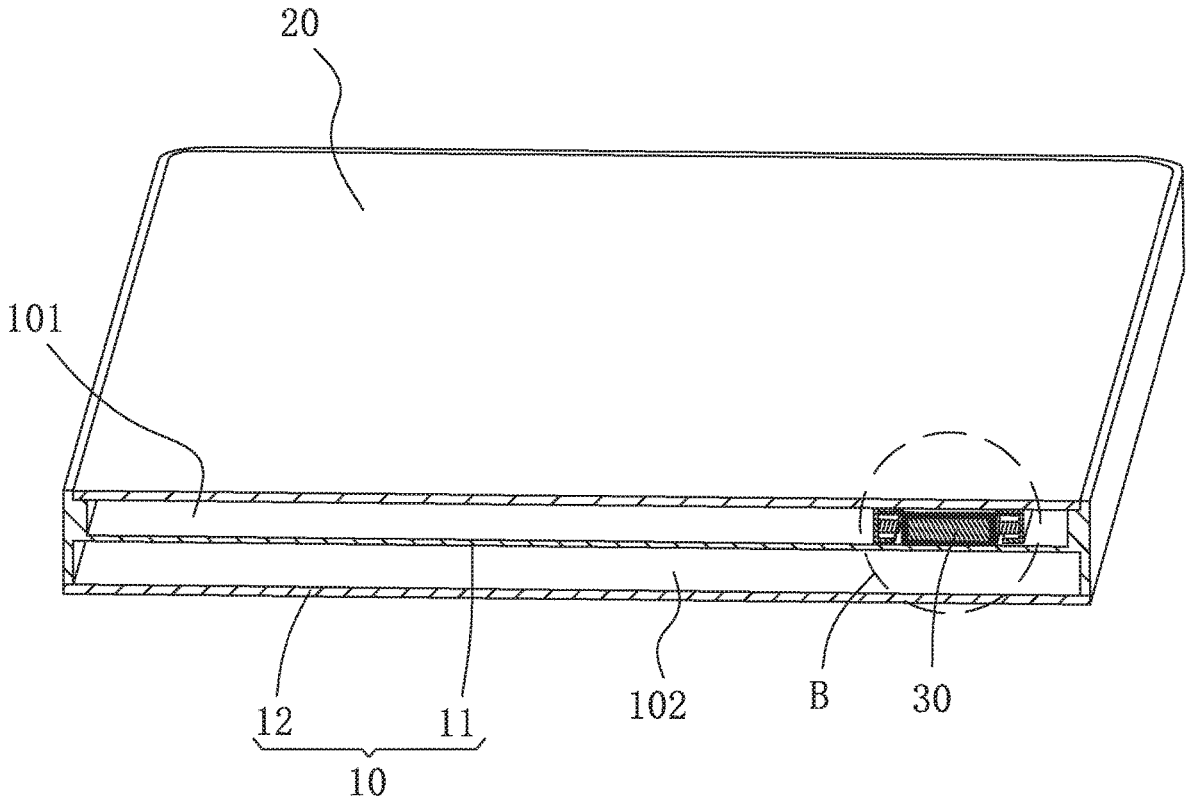
FIG. 3 is a cross-sectional view of the screen sounding device taken along line A-A in FIG. 2.
Figure 4:
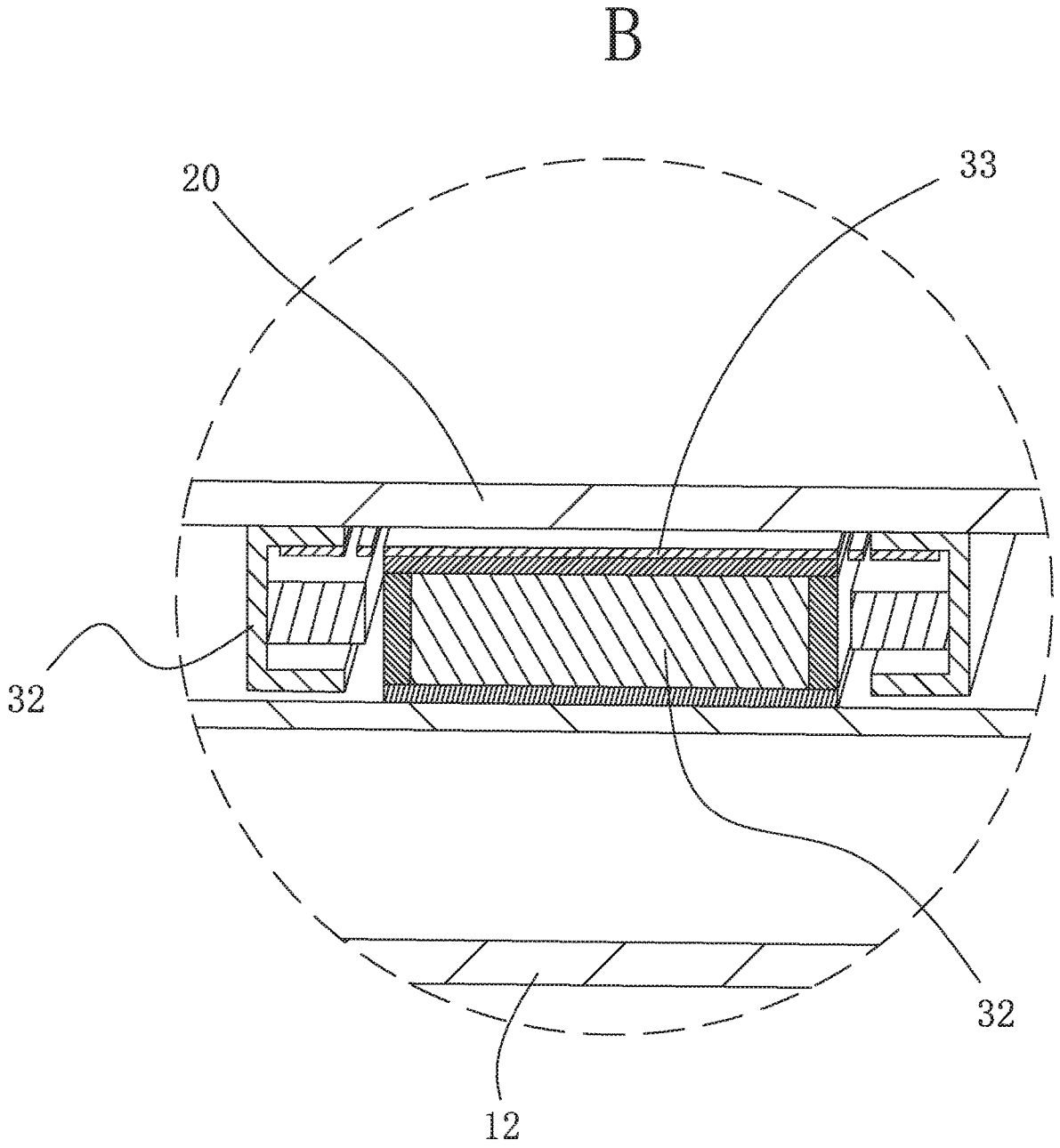
FIG. 4 is an enlarged view of Part B in FIG. 3.
Figure 5:
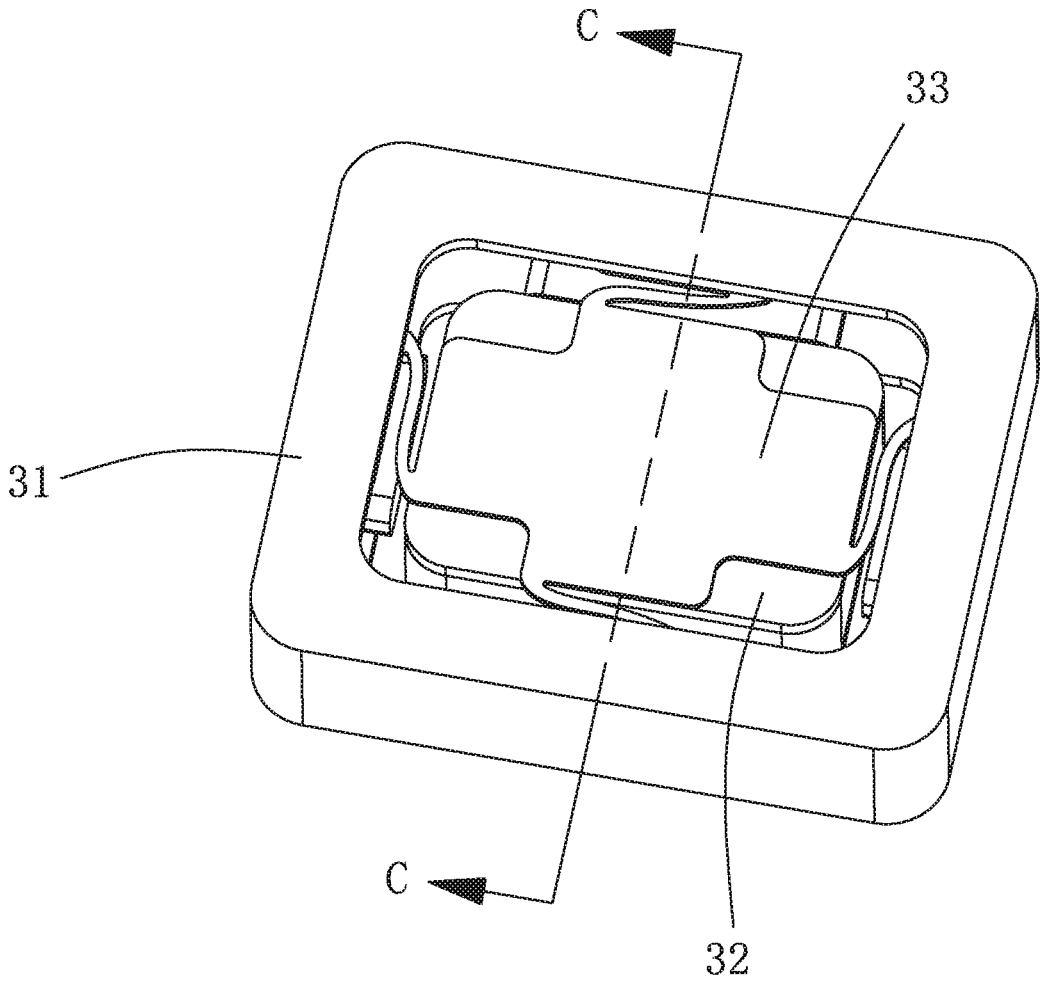
FIG. 5 is an assembled view of a driving device of the screen sounding device in the first embodiment.

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby are only to explain the disclosure, not intended to limit the disclosure.

As shown in FIGS. 1-7, a screen sounding device of a first embodiment of the invention is disclosed. In the first embodiment, the screen sounding device comprises a frame 10, a screen 20 installed on the frame 10 and a driving device 30 arranged between the frame 10 and the screen 20 for driving the screen 20 to vibrate and sound. The driving device 30 comprises a magnetic circuit system 31 fixed on the screen 20, an electromagnet 32 fixed on the frame 10 to drive the magnetic circuit system 31 to vibrate, and an elastic connector 33 connecting the magnetic circuit system 31 and the electromagnet 32. The magnetic circuit system 31 comprises a magnet 311 arranged around the electromagnet 32 and a magnetic frame 312 fixing the magnet 311. Specifically, the magnetic frame 312 comprises a top wall 3121 fixed on the screen 20, a bottom wall 3122 arranged opposite to the top wall 3121 and a side wall 3123 connecting the top wall 3121 and the bottom wall 3122. The magnet 311 is fixed on the side wall 3123 facing to a side surface of the electromagnet 32.

The screen sounding device provided in the invention adopts a structural design of an electromagnetic type to drive the screen to vibrate and sound. When electrified, the electromagnet 32 interacts with the magnetic circuit system 31 to drive the magnetic circuit system 31 to vibrate so as to drive the screen 20 to vibrate thereby producing audible sounds. Comparing with a structural design adopting the driving device of piezoelectric type in related technology, greater driving force can be provided between the magnetic circuit system 31 and the electromagnet 32 driven by the electromagnetic type of the invention with low energy consumption, then the screen sounding device can obtain better sounding performance. In addition, the invention adopts a structural design of electromagnetic type driving the screen to vibrate and sound, comparing with traditional speaker/receiver, the screen sounding device of the invention omits traditional diaphragm structure of the sounding device. The production cost is lower.

Figure 6:
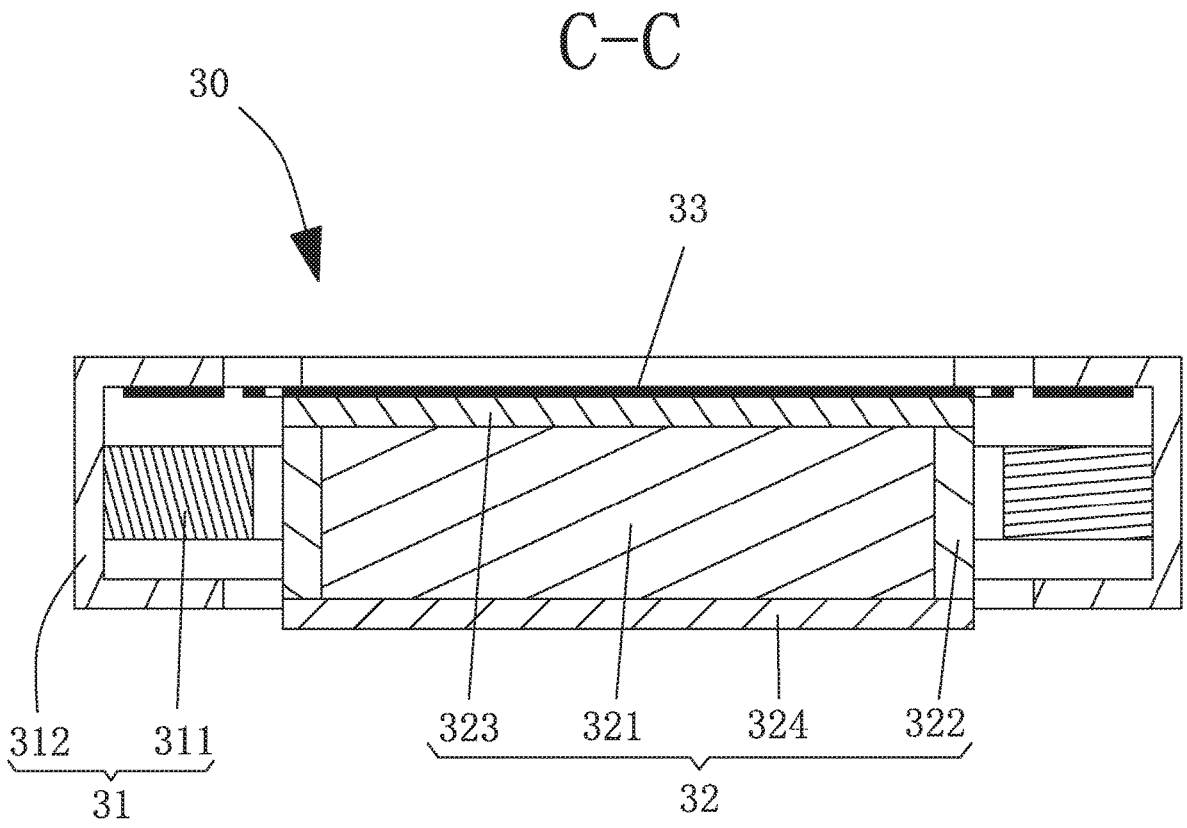
FIG. 6 is a cross-sectional view of the driving device taken along line C-C in FIG. 5.
Figure 7:
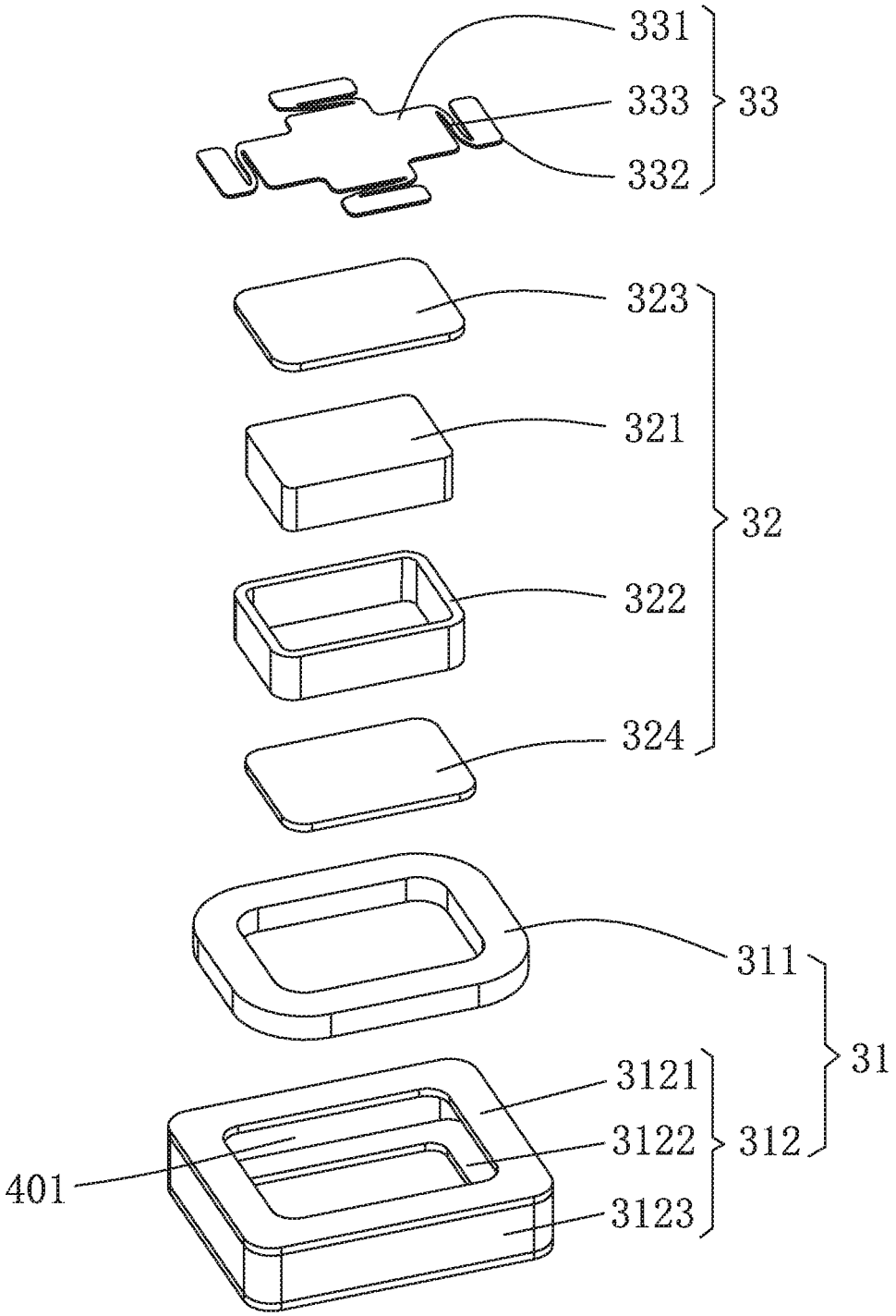
FIG. 7 is an exploded view of the driving device in the first embodiment.

In the first embodiment of the invention, as shown in FIG. 6 and FIG. 7, the electromagnet 32 comprises an iron core 321, a coil 322 wound around the iron core 321, an upper magnetic covering plate 323 arranged on the iron core 321 and being close to one side of the screen 20 and a lower magnetic covering plate 324 arranged on one side of the iron core 321 away from the screen 20. The lower magnetic covering plate 324 is fixed on the frame 10. During the process of operation, the electromagnet 32 interacts with the magnetic circuit system 31, and drives the magnetic circuit system 31 to vibrate to drive the screen 20 for generating sound. As amplitude of the screen 20 is small during sounding process, corresponding devices of the screen sounding device can be made more slim, and size of assembled screen sounding device can be smaller. In the process of voice production, the iron core 321 can improve magnetic effect stronger, the upper magnetic plate 323 and the lower magnetic plate 324 are helpful for magnetic conduction.

Specifically, the elastic connector 33 in the screen sounding device comprises a first fixing part 331 fixed on the upper magnetic covering plate 323 being close to one side of the screen 20, a second fixing part 332 fixed on a top wall 3121 being far away from one side of the screen 20, and an elastic arm 333 connecting the first fixing part 331 and the second fixing part 331. Elastic deformation elasticity is produced between the first fixing part 331 and the second fixing part 332 by the elastic arm 333. The elastic force cooperates with magnetic action between the electromagnet 32 and the magnetic circuit system 31 to complete resonance vibration. As shown in FIG. 7, in fact, the top wall 3121 and the second fixing part 332 are welded and fixed (i.e., the elastic connector 33 is made of metal material). In the invention, the plate spring-type elastic connector 33 is adopted to realize the integrated installation between the magnetic frame 312 and the electromagnet 32, based on which, the installation is simple and reliable.

In the invention, the magnet 311 magnetizes along a direction being perpendicular to the vibration direction of the screen 20.

Shown as FIG. 6 and FIG. 7, the magnet 311 of the first embodiment is an integrated ring. In addition, the magnetic frame 312 of the first embodiment is an integrated ring, namely the top wall 3121, the side wall 3123 and the bottom wall 3122 are integrally formed. The top wall 3121, the side wall 3123 and the bottom wall 3122 can be integrally formed by casting method, and form a ring assembly inner groove 401. Or, the ring assembly inner groove 401 can be machined by adopting numerical control machine to form the integrated magnetic frame 312.

In the first embodiment, the frame 10 and the middle frame 11 connecting with the screen 20 and the back cover 12 covering one side of the middle frame 11 opposite to the screen 20. The screen 20 and the back cover 12, with the middle frame 11 separately, form a first accommodation cavity 101 and a second accommodation cavity 102. The driving device 30 is accommodated in the first accommodation cavity 101 and the electromagnet 32 fixed on the middle frame 11. The screen sounding device further comprises a circuit main board 40 assembled in the first accommodation cavity 101. The circuit main board 40 is connected with the coil 322 of the electromagnet 32 electronically. The screen 20 comprises a display screen 21 and a glass panel 22 which are stacked layer by layer. The display screen 21 is accommodated in the second accommodation cavity 102 for connecting with the circuit main board 40 electronically through connecting cable. An edge of the glass panel 22 is connected with a corresponding edge of the middle frame 11 for forming a second accommodation cavity 102. A display plane of the display screen 21 is attached on the glass panel 22.

Figure 8:
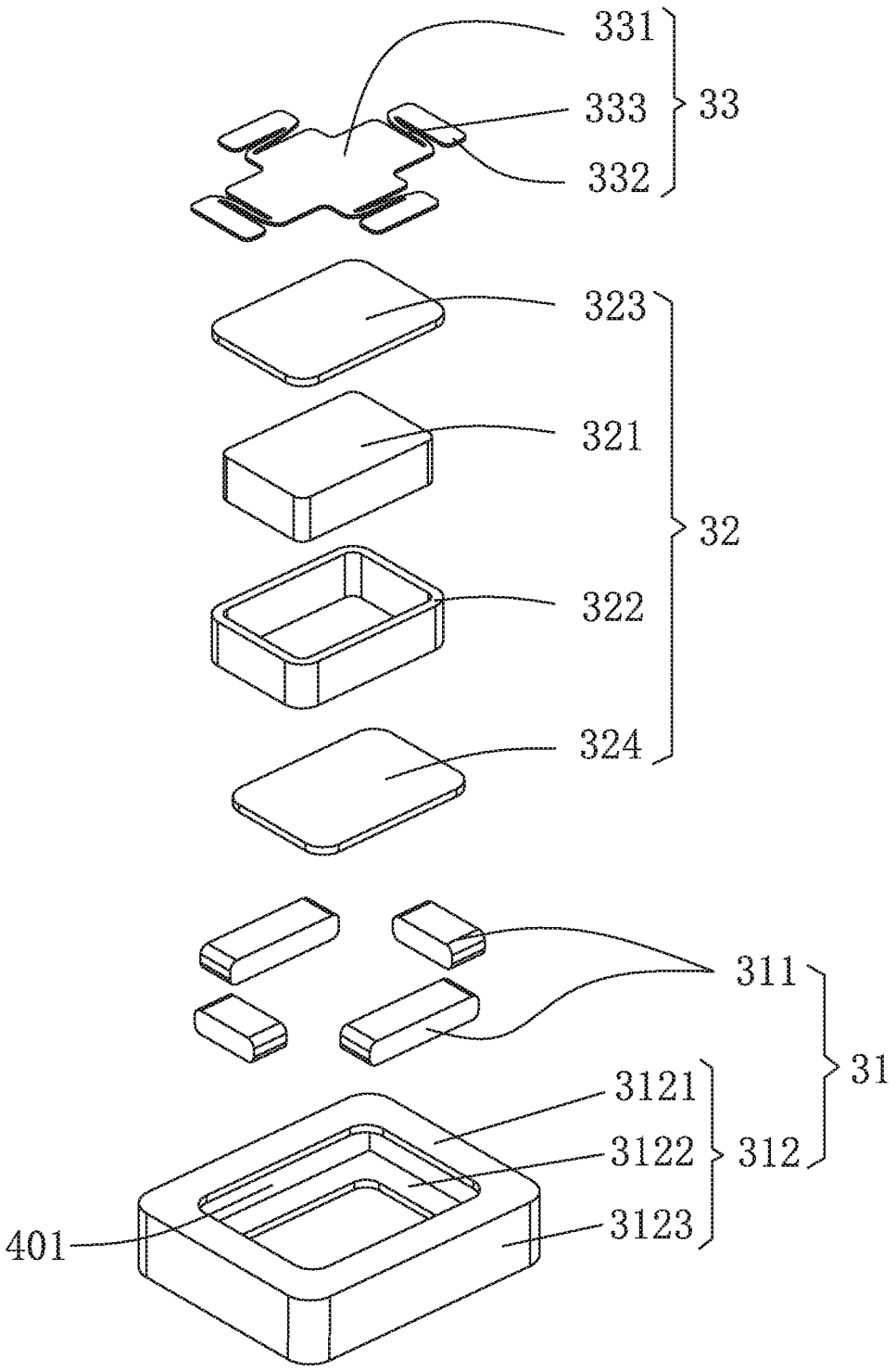
FIG. 8 is an exploded view of a driving device in accordance with a second embodiment of the present invention.

As shown in FIG. 8, a driving device in accordance with a second embodiment of the screen sounding device is disclosed. Comparing with the structure of the screen sounding device of the first embodiment, the structure of the screen sounding device of the second embodiment has the following differences: the multiple magnet 311 are arranged, and the multiple magnets 311 are distributed evenly around the electromagnet 32.

Figure 9:
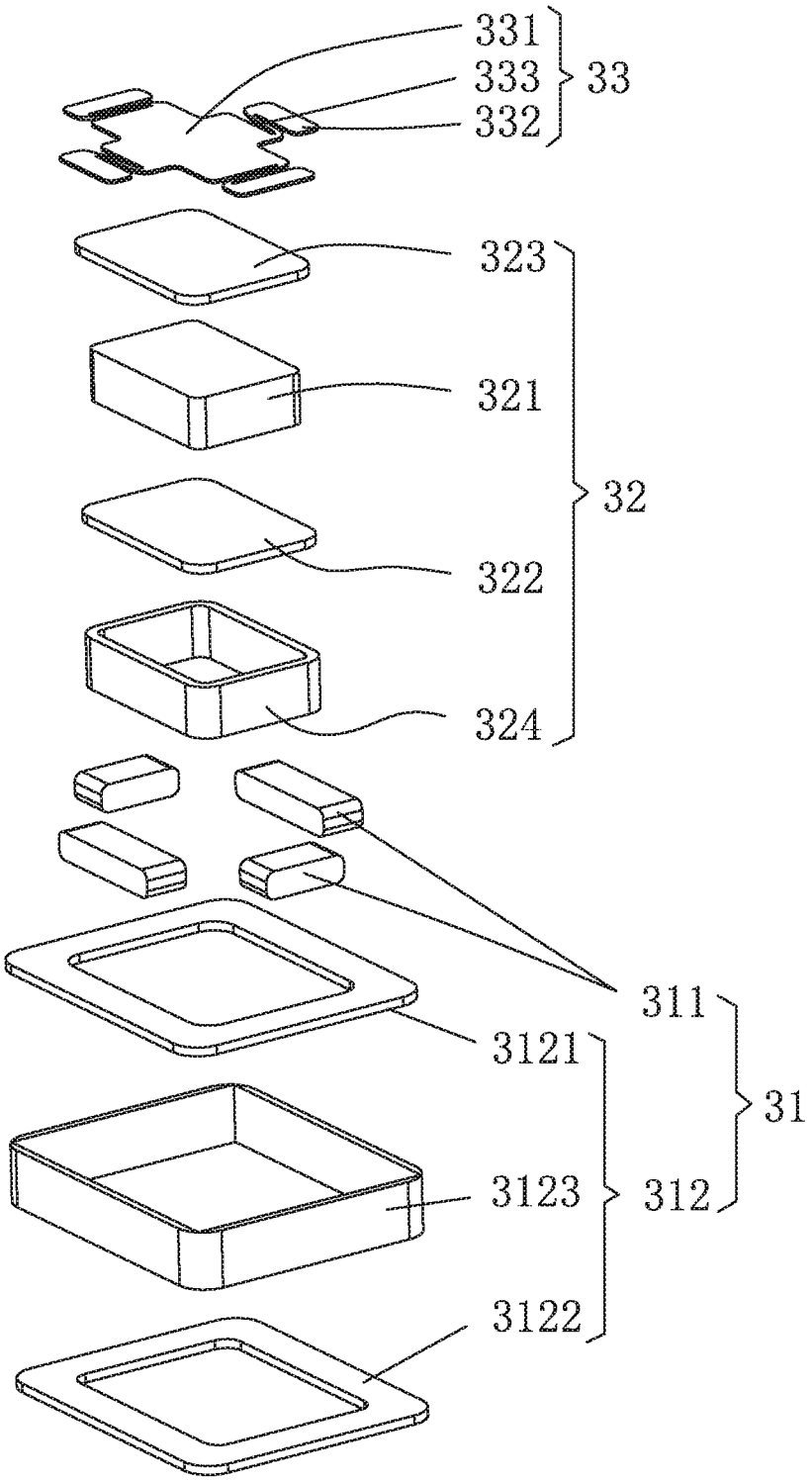
FIG. 9 is an exploded view of a driving device in accordance with a third embodiment of the present invention.

The rest structure of the screen sounding device of the second embodiment is the same as the corresponding structure of the first embodiment, As shown in FIG. 9, a driving device in accordance with a third embodiment of the screen sounding device is disclosed. Comparing with the structure of the screen sounding device of the first embodiment, the structure of the screen sounding device of the third embodiment has the following differences: the top wall 411, the side wall 412 and the bottom wall 413 are independent plates, and the top wall 411, the side wall 412 and the bottom wall 413 are welded, fixed to form the ring assembly inner groove 401. A separate magnetic frame 312 including the top wall 411, the side wall 412 and the bottom wall 413 is presented. During assembly, comparing with the integrated magnetic frame 312 of the first embodiment, requirements and cost of welding technology is far lower than machining, in addition, the magnet 311 in a third embodiment is multiple. The multiple magnets 311 are distributed along an end-to-end ring.

Or, comparing with the structures of the third embodiment and the screen sounding device of the second embodiment, the top wall 411, the side wall 412 and the bottom wall 413 are independent plates, and the top wall 411, the side wall 412 and the bottom wall 413 are welded, fixed and form ring assembly an inner groove 401. The separated magnetic frame 312 including the top wall 411, the side wall 412 and the bottom wall 413 is presented. During assembly, comparing with the integrated magnetic frame 312 of the first embodiment, the requirements and cost of welding technology is far lower than machining process.

The rest structure of the screen sounding device of the third embodiment is the same as that of corresponding structure of the first embodiment or the second embodiment.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A screen sounding device, comprising:

a frame;

a screen installed on the frame;

a driving device arranged between the frame and the screen for driving the screen to vibrate for generating sound; the driving device comprising:

a magnetic circuit system fixed on the screen;

an electromagnet fixed on the frame for driving the magnetic circuit system to vibrate, the magnetic circuit system including a magnet arranged around the electromagnet and a magnetic frame having a top wall fixing the screen, a bottom wall arranged opposite to the top wall and a side wall connecting the top wall to the bottom wall for fixing the magnet; wherein the screen sounding device further includes an elastic connector connecting the magnetic circuit system and the electromagnet, and the magnet is fixed on the side wall and facing a side surface of the electromagnet;

the electromagnet comprises an iron core, a coil wound around the iron core, an upper magnetic covering plate arranged on the iron core and being close to one side of the screen, and a lower magnetic covering plate arranged on the iron core and being away from one side of the screen; the lower magnetic covering plate is fixed on the frame.

2. The screen sounding device as described in claim 1, wherein the elastic connector comprises a fixing part fixed on the upper magnetic covering plate and being close to one side of the screen, a second fixing part fixed on the top wall and being away from one side of the screen, and an elastic arm connecting the first fixing part and the second fixing part.

3. The screen sounding device as described in claim 1, wherein the magnet magnetizes along a vibration direction of the screen.

4. The screen sounding device as described in claim 1, wherein the magnet is an integrated ring.

5. The screen sounding device as described in claim 1 including a plurality of magnets, wherein the plurality of magnets are distributed evenly surrounding the electromagnet.

6. The screen sounding device as described in claim 1, wherein the top wall, the side wall and the bottom wall are integrally formed.

7. The screen sounding device as described in claim 1, wherein the top wall, the side wall and the bottom wall are separately formed, and the top wall, the side wall and the bottom wall are welded and fixed with each other.

8. The screen sounding device as described in claim 1, wherein the frame comprises a middle frame connected with the screen and a back cover covering one side of the middle frame opposite to the screen; the screen and the back cover, respectively with the middle frame separately, form a first accommodation cavity and a second accommodation cavity; the driving device is accommodated in the first accommodation cavity and the electromagnet is fixed in the middle frame.

* * * * *